United States Patent [19]

Lee

[11] Patent Number: 4,758,197

[45] Date of Patent: Jul. 19, 1988

[54] TOY WINDMILL AND NOISE MAKER

[76] Inventor: Hop Lee, 2455 24th Ave., San Francisco, Calif. 94121

[21] Appl. No.: 924,914

[22] Filed: Oct. 29, 1986

[51] Int. Cl.[4] ..... A63H 5/00; A63H 33/40

[52] U.S. Cl. ..... 446/213; 446/217; 446/418

[58] Field of Search ..... 446/217, 218, 420, 418, 446/488; D21/92, 93; 206/805; 84/411 M, 420, 422 S; 124/16, 17; 403/346, 347; 24/D9, 1, 437

[56] References Cited

U.S. PATENT DOCUMENTS

| | | | |
|---|---|---|---|
| D. 152,877 | 3/1949 | Geldard | 84/422 S |
| D. 197,901 | 4/1964 | Lee | D21/93 |
| 363,755 | 5/1887 | Myers | 124/20 R |
| 363,756 | 5/1887 | Myers | 124/20 R |
| 2,293,251 | 8/1942 | Fords | 84/297 R |
| 2,396,250 | 3/1946 | Clayman | 84/420 |
| 3,392,481 | 7/1968 | Lee | 446/213 |
| 3,475,850 | 11/1969 | Lee | 446/217 |
| 3,866,508 | 2/1975 | Huslig | 84/422 S |

*Primary Examiner*—Robert A. Hafer
*Assistant Examiner*—Michael Brown
*Attorney, Agent, or Firm*—Majestic, Gallagher, Parsons & Siebert

[57] ABSTRACT

A toy windmill and noise maker comprises a frame and handle. The frame rotatably carries a shaft that has a windmill mounted at one end for rotating the shaft. The handle is connected to the center of the bottom member of the frame so that the device is balanced. Radially extending paddles are carried by the shaft and these actuate drumsticks that beat upon a metal drum supported by the frame. A rubber band having two enlarged ends is stretched across two side members of the frame and supports the drumsticks and causes them to strike the drum after they have been released by the paddles. The bottom member of the frame defines a depression therein near the drum to avoid damping the drum. The windmill is formed from a single square blank which has cuts therein to define the four blades. The four blades have integral extensions where the extensions of diagonally opposed blades are connected to each other in two pairs to hold the blades in concave shape. In each pair of extensions to be connected, one extension is in the shape of a tongue and the other defines a slot therein in the shape of numeral "7".

5 Claims, 3 Drawing Sheets

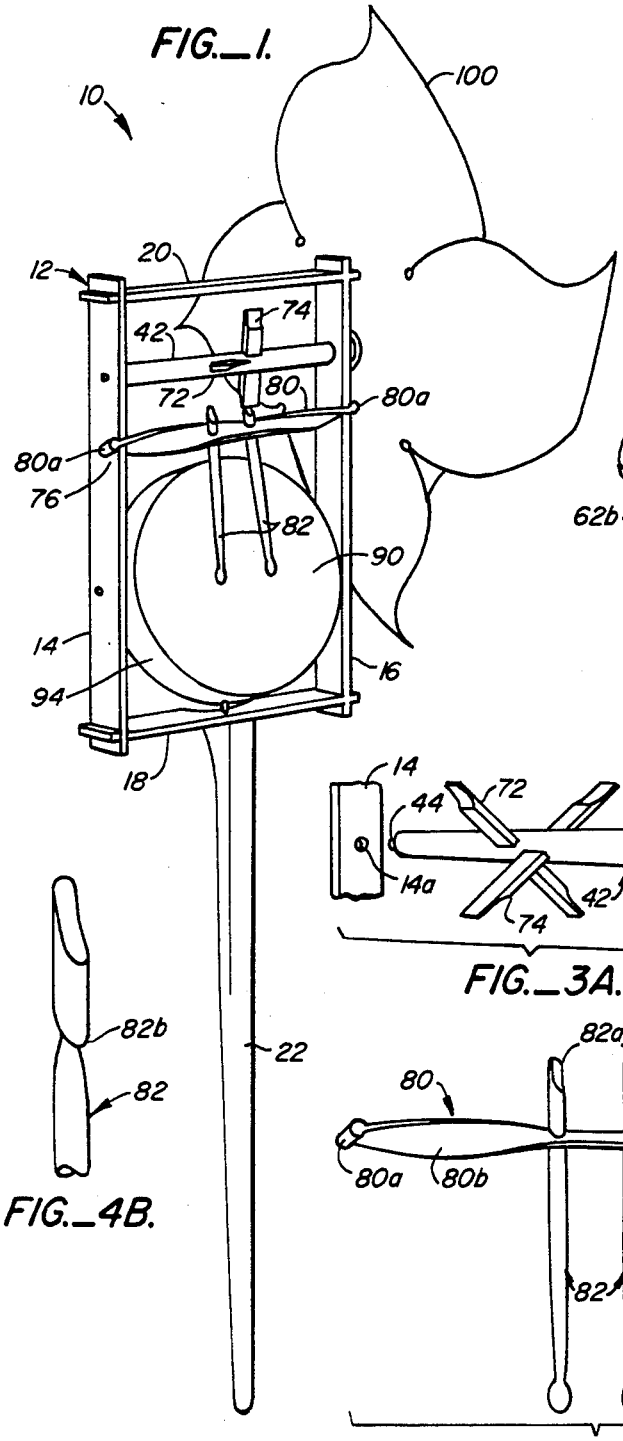
FIG._1.
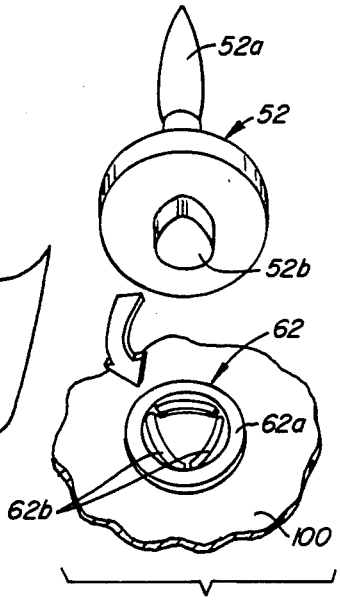
FIG._3B.
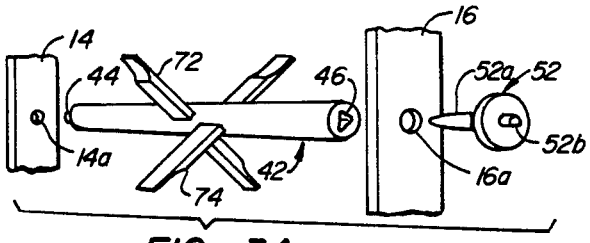
FIG._3A.
FIG._4B.
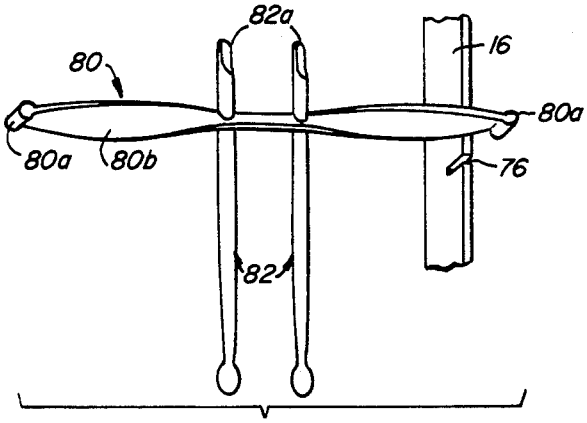
FIG._4A.

TOY WINDMILL AND NOISE MAKER

BACKGROUND OF THE INVENTION

In U.S. Pat. No. 3,392,481 to applicant, a toy windmill and noise maker is disclosed which comprises a frame and handle. The frame rotatably carries a shaft which has a windmill mounted at one end for rotating the shaft. Radially extending paddles are carried by the shaft and these actuate drumsticks that beat upon a metal drum supported by the frame. An endless rubber band is stretched across the two side members of the frame and supports the drumsticks and causes them to strike the drum after they have been released by the paddles.

In U.S. Pat. No. 3,475,850 to applicant, the structure of the windmill is disclosed. The windmill is formed from a single square blank. The blank has cuts therein to define the four blades and these blades have integral extensions that are used for curving the blades when the windmill is mounted for rotation. The extensions of two adjacent blades are provided with slots and the extensions of the two remaining blades with tongues for interconnecting the extensions of diagonally opposed blades to hold the blades in concave shape.

While the above described construction of a toy windmill and noise maker device is advantageous, its function in some aspects is not entirely satisfactory. It is therefore desirable to provide an improved toy windmill and noise maker device whose function is improved.

SUMMARY OF THE INVENTION

Certain features of the toy windmill and noise maker device as disclosed in U.S. Pat. Nos. 3,392,481 and 3,475,850 have been retained in the improved device. Thus the improved device comprises a substantially square or rectangular frame, said frame including two spaced apart side members, each member having an inclined slot therein. The device comprises a shaft rotatably carried by said side members and a toy windmill connected to the shaft for rotating it and a drum carried by the frame. The device further comprises one or more drumsticks for beating the drum and at least one paddle carried by the shaft and swung through a predetermined path when the shaft is rotated for causing the drumsticks to hit the drum in a manner described below.

According to one aspect of the invention, instead of an endless rubber band, the improved device employs a rubber band having two ends larger in dimension than the remaining portion of the band and the slots in the members. The inside portion of the rubber band near the two ends are received in the slots in the two side members so that the rubber band is in tension with its ends outside the frame and abutting the frame.

According to another aspect of the invention, the device is provided with a handle connected at or near the center of one side of the frame, so that when the device is held by the handle and when the shaft is rotated by the windmill causing the drumsticks to strike the drum, the device is substantially balanced.

The drum has a flange, where the flange defines three holes therein in which three fingers protruding from the inside surfaces of the frame fit, thereby holding the drum to the frame. Yet another aspect of the invention is directed to the shape of the bottom member of the frame; the bottom member defines a depression on its surface near the finger thereon, said depression shaped so that when the drum is held in place by the three fingers, the drum is spaced apart from the bottom member to avoid damping vibrations of the drum.

Still another aspect of the invention is directed to the mechanism for connecting the extensions of the four blades in the flexible blank forming the windmill. Instead of having a slot in the shape of a straight line as disclosed in U.S. Pat. No. 3,475,850, the end of one extension in each of two pairs of the diagonally opposed blades defines a slot in the shape of numeral "7" having a longer section substantially in the same direction as the length of the extension and a shorter section in a direction transverse thereto. The other extension in each of the two pairs defines a tongue having a neck portion and a head portion, where the head portion is larger in dimension than the length of the shorter section, so that when the tongues are inserted in the associated slot, the head portions are retained within the shorter sections thereby removably connecting the extension pairs.

BRIEF DESCRIPTION OF THE DRAWINGS

FIG. 1 is a perspective view of a toy windmill and noise maker device to illustrate the preferred embodiment of the invention.

FIG. 3A is a perspective view of sections of the two side members 14, 16 and the shaft 42 of FIG. 1 to illustrate the preferred embodiment of the invention.

FIG. 3B is a perspective view of a stub shaft and a portion of the windmill to illustrate how the windmill may be connected to the frame of the device.

FIG. 4A is a perspective of a rubber band, two drumsticks and side member 16 of FIG. 1 to illustrate the preferred embodiment of the invention.

FIG. 4B is a perspective view of the upper portion of a drumstick to illustrate the preferred embodiment of the invention.

DETAILED DESCRIPTION OF THE PREFERRED EMBODIMENT

Figure 2:
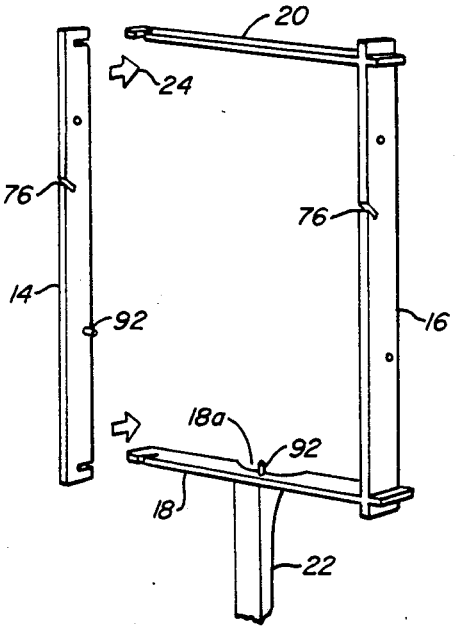
FIG. 2 is an exploded view of the frame portion of the device of FIG. 1 to illustrate the preferred embodiment of the invention.

FIG. 1 is a perspective view of a toy windmill and noise maker device to illustrate the preferred embodiment of the invention. As shown in FIG. 1, device 10 includes a frame 12 which is substantially rectangular in shape. While in the preferred embodiment, frame 12 is shown as substantially rectangular in shape, it will be understood that frames of other shapes may also be used such as one which is substantially square, and all such configurations are within the scope of the invention.

As shown in FIG. 1, frame 12 comprises two side members 14, 16 spaced apart from each other, a bottom member 18 and a top member 20. Securely connected at or near the center of the bottom member 18 is a handle 22. For ease of manufacture, side member 16, top and bottom members 20, 18 and handle 22 may be made as one piece by a process such as molding. Side member 14 is made separately; side member 14 and top and bottom members 20, 18 are each provided with matching grooves so that they can be connected by dovetailing the groove portions of the members in a manner illustrated in FIG. 2. Arrow 24 illustrates the direction for moving side member 14 towards the bottom and top members 18, 20 for dovetailing.

Device 10 includes a windmill 100 and a shaft 42 connected to the side members 14, 16 in the manner described in reference to FIGS. 3A, 3B. FIG. 3A is a perspective view of sections of the two side members 14, 16 and the shaft 42 to illustrate the preferred embodiment of the invention. As shown in FIG. 3A, members 14, 16 define holes 14*a*, 16*a* therein. Shaft 42 has an end 44 of smaller cross section than the remainder of the shaft, where end 44 is adapted to fit rotatably into hole 14*a* of member 14. The other end of shaft 42 defines a hole 46 which is substantially triangular in cross-section. Stub shaft 52 has a generally triangular portion 52*a*; portion 52*a* is of such dimension that it passes through hole 16*a* and can be rotated in such hole with ease, and that portion 52*a* fits snugly into hole 46 in shaft 42. Thus, when portion 52*a* is inserted into hole 16*a* and then into hole 46, shaft 42 and stub shaft 52 are connected to member 16 where shaft 42 may be rotated by the rotation of stub shaft 52. When end 44 is also inserted into hole 14*a*, the assembly of the shaft 42 onto frame 12 is complete.

Stub shaft 52 has a portion 52*b* opposite to portion 52*a* where portion 52*b* is also generally triangular in shape. As shown more clearly in FIG. 3B, portion 52*b* is adapted to fit snugly into eyelet 62 at the back of the windmill 100. Eyelet 62 comprises ring 62*a* and an inner split ring 62*b* which is generally triangularly shaped and whose inner dimensions are such as to grab portion 52*b* of the stub shaft when portion 52*b* is inserted into the inner ring 62*b*. In such manner windmill 100 may be connected securely to stub shaft 52, thereby securely connecting the windmill to frame 12 and shaft 42. As shown in FIG. 3B, portion 52*b* is generally triangular in cross-section with rounded corners.

Shaft 42 carries two paddles 72, 74 chamfered at both ends for rotating certain drumsticks in the noise maker part of the device. The noise maker part of the device is illustrated in reference to FIGS. 1, 2, 4A, 4B and 5. As shown in FIGS. 1 and 2, side members 14 and 16 each defines a slanting slot 76 therein for holding a rubber band 80. As best shown in FIG. 4A, rubber band 80 comprises two ends 80*a* which are larger in dimension than the remaining portion 80*b*. Ends 80*a* are also larger in dimension than slot 76. The unstretched length of band 80 is smaller than the distance between side members 14 and 16 after frame 12 is assembled as explained above. Thus, when the thinner portion 80*b* is inserted in the slot 76, band 80 will be stretched and in tension and band 80 is held in place by their ends 80*a* outside the frame and abutting the frame. Rubber band 80 defines two holes therein for carrying two drumsticks 82. The drumsticks 82 each has one end which is egg-shaped for hitting on a certain drum in the noise maker portion of the device. The other end 82*a* of each drumstick is chamfered.

Figure 6:
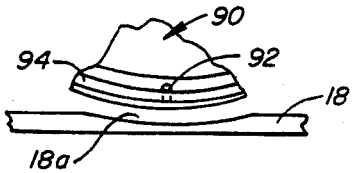
FIG. 6 is a perspective view of a portion of the drum and a bottom member of the device of FIG. 1 to illustrate the preferred embodiment of the invention.
Figure 5:
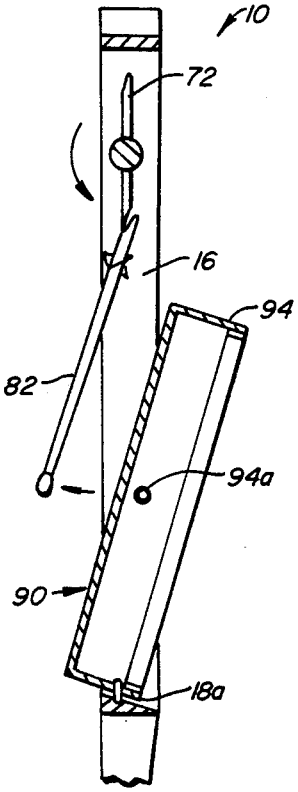
FIG. 5 is a cross-sectional view of the device of FIG. 1 to illustrate the preferred embodiment of the invention.

As shown in FIGS. 1, 5 and 6, device 10 includes a drum 90 attached to side members 14, 16 and bottom member 18. As best shown in FIG. 2, side members 14, 16 and bottom member 18 each defines a protrusion or finger 92 for carrying the drum 90. Referring back to FIGS. 1 and 5, drum 90 has a flange 94 which defines therein three holes 94*a* adapted to receive therein fingers 92. Thus, drum 90 is moved towards the bottom member 18 and side member 16 until two of the holes 94*a* receive fingers 92 protruding from those two members. Then side member 14 is moved towards drum 90 until the finger 92 protruding from member 14 is inserted into the remaining hole 94*a*. Member 14 is then connected to the top and bottom members as described above. In such manner drum 90 is secured to frame 12.

As shown in FIG. 1, when the windmill 100 rotates the shaft 42, paddles 72 and 74 are also rotated. As shown in FIGS. 1, 4A, rubber band 80 is twisted so as to urge the egg-shaped ends of the drumsticks 82 towards drum 90. Thus, unless otherwise moved, the egg-shaped ends of the drumsticks 82 are in contact with drum 90 and are uged towards drum 90 by the rubber band. When shaft 42 is rotated by the windmill, however, paddle 72, 74 are also rotated. The ends of the paddles are then rotated in predetermined paths. Shaft 42 and band 80 are placed in such relative positions that ends 82*a* of the drumsticks are in the path of rotation of the ends of paddles 72, 74. Therefore, when the ends of paddles 72, 74 are rotated in their predetermined paths, they come into contact with ends 82*a* of the drumsticks and intermittently causes the egg-shaped ends of the drumsticks to move away from the drum 90. As the ends of the paddles move past the chamfered ends 82*a* of the drumsticks, the drumsticks are thereby released, causing the egg-shaped ends of the sticks to hit the drum 90 and to create the desired sounds.

The above described features of device 10 are advantageous over that described in the two patents referenced above. Instead of using a continuous rubber band, band 80 has two ends. The rubber band used in the device 10 should apply sufficient force to drumsticks 82 so that the drumsticks will hit the drum with sufficient force to make the desired noise; on the other hand, the rubber band should not apply too great a force as to cause side members 14 and 16 to bend, since repeated bending may cause the side members to break.

With a continuous loop type rubber band as in U.S. Pat. No. 3,392,481, the band loops around the two side members so that the two portions of the band urging side members 14 and 16 towards each other may be of different lengths depending on how the band is looped around the side members. Hence the two portions of the band may apply different forces to the side members; since the two portions of the band may have very different tensions, the force applied to the drumsticks depends on the tension of the portion of the band carrying the drumsticks. Therefore, the effect of the rubber band on the side members and on the noise made may depend on the skill of the person assembling device 10 which is undesirable. With the rubber band of the type as band 80 described above, no skill is required of the assembler of device 10 and essentially the same forces applied to the drumsticks and to the side members are obtained irrespective of who assembles the device. This is particularly advantageous for a toy where a child may lack the dexterity for assembling the device in a manner that the desired forces are applied to the drumsticks and the side members.

Further aspects of the invention are illustrated in reference to FIGS. 1, 2, 5 and 6. In the noise maker device described in the U.S. Pat. No. 3,392,481, the drum may come into contact with the frame, thereby causing damping of the vibrations of the drum. This is undesirable since damping reduces the loudness of the sound when the drum is hit by drumsticks. To alleviate such difficulty, bottom member 18 of device 10 of this invention is designed so that the portion of the bottom member near finger 92 defines a depression 18*a*. Depression 18*a* is of such shape and the fingers 92 on side members 14, 16 are at such distances from the bottom member 18 when assembled that when the drum is held in place by the three fingers 92, flange 94 of the drum is spaced apart from the bottom member to avoid damping the drum vibrations.

Yet another aspect of the invention is illustrated in reference to FIG. 4B which is a perspective view of the top portion of a drumstick 82. As shown in FIG. 4B, drumstick 82 has a neck portion 82*b* which is smaller in cross-section than adjacent portions of the drumstick. The two holes of rubber band 82 have essentially the same dimensions as neck 82*b* so that when the drumsticks 82 are inserted into the holes until the neck portions 82*b* are in the holes, the drumsticks are held snugly by the rubber band to prevent the drumsticks from slipping out of the holes.

In the device of U.S. Pat. No. 3,392,481, the handle of the device is off to one side of the frame as can be seen from FIGS. 1 and 2 of the patent. When the shaft in such device is rotated by the windmill, the location of the handle may cause the person holding the handle to tilt the device when the windmill is rotated. This may increase the difficulty in handling of the device, particularly for children. In device 10 of this invention, handle 22 is connected at or near the center of bottom member 18, so that the device is substantially balanced even when windmill 100 is rotating. As a result, device 10 is much easier to handle, particularly for children, as compared to prior art devices.

Figure 8B:
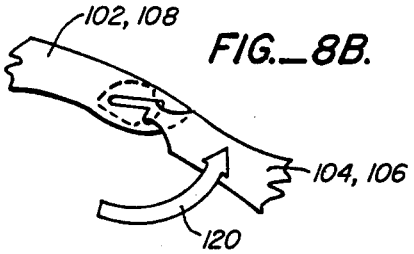
FIGS. 8A and 8B are schematic views of certain portions of certain portions of the blank of FIG. 7 illustrating how the windmill can be formed from the blank.
Figure 8A:
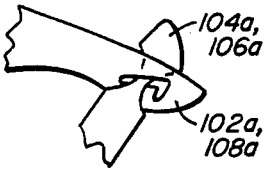
Figure 7:
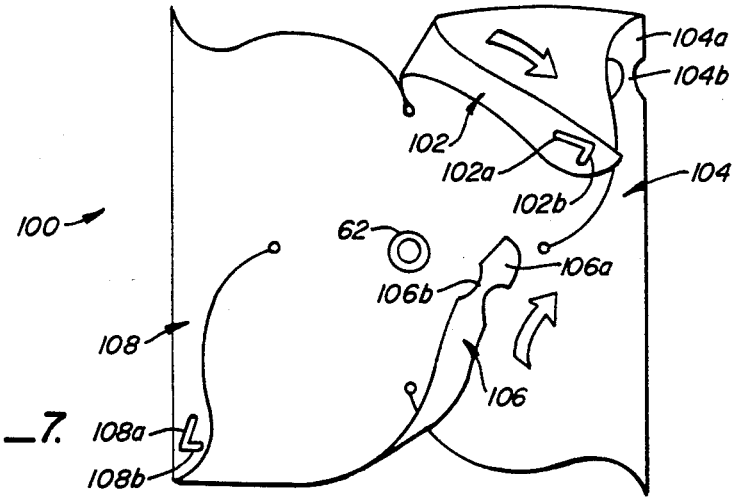
FIG. 7 is a perspective view of a blank with cuts therein for forming the windmill to illustrate the preferred embodiment of the invention.
Figure 9:
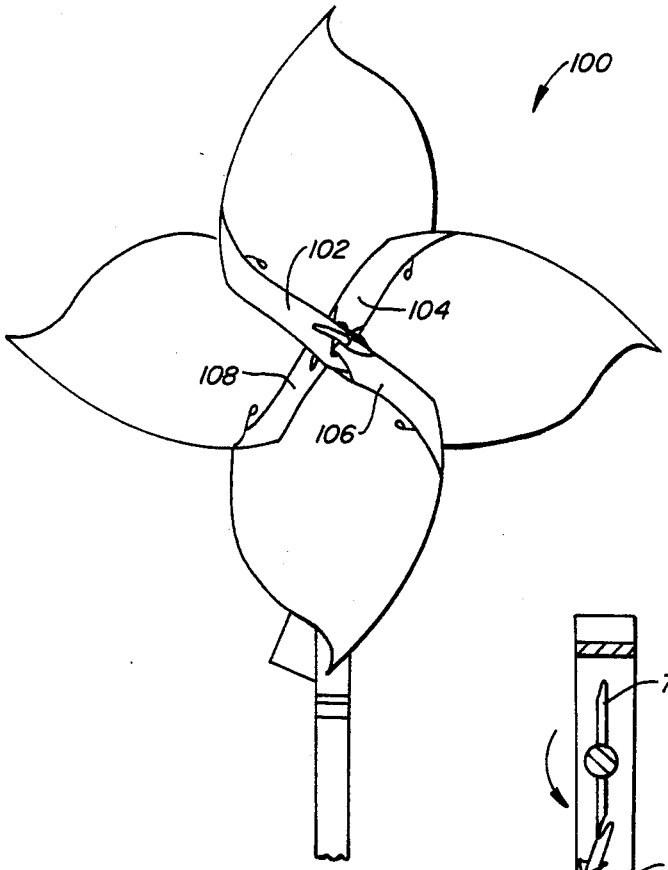
FIG. 9 is a side view of the upper portion of the device of FIG. 1 to illustrate the structure of the windmill.

The windmill portion of the device will now be described in reference to FIGS. 7, 8 and 9. As best shown in FIG. 7, the windmill portion comprises a substantially square blank 100. As shown in FIG. 7, blank 100 has cuts therein to define four blades, 102, 104, 106 and 108. Blades 102 and 106 form a pair and blades 104 and 108 form a second pair. Each pair of blades has extensions which are connected to hold the blades in concave shape. Thus, extensions of blades 104 an 108 are to be connected and so are extensions of blades 102 and 106. Extensions of blades 102 and 108 each defines therein a slot that is in the shape of a numeral "7". The slot each has a longer section (102*a*, 108*a*) substantially in the same direction as the length of the extension and a shorter section (102*b*, 108*b*) in a direction transverse to the length of the extension as shown in FIG. 7.

The extensions of blades 104 and 106 are further cut so that their ends are in the shapes of tongues, comprising a head portions 104*a*, 106*a* and neck portions 104*b* and 106*b*. Portions 104*a* and 106*a* are of such dimensions that they can be inserted into the "7" shaped slot easily and conveniently as shown in FIG. 8A. Such head portions, however, are larger in dimensions than the length of corresponding shorter sectios 102*b* and 108*b*. After the head portions have been inserted into the slots as shown in FIG. 8A, the extensions of blades 104 and 106 are rotated along the direction of the arrow 120 in FIG. 8B, and the tongues 104*a* and 106*a* are thus retained within the shorter sections 102*b* and 108*b*. The two pairs of extensions are thereby removably connected for form a windmill in the configuration shown in FIG. 9, where the planes of the tongues are substantially parallel to those of the extensions with slots therein.

The above-description of construction and method is merely illustrated thereof and various changes in the designs and steps may be within the scope of the appended claims.

I claim:

1. A toy windmill and noise maker device comprising:

a substantially square or rectangular frame, said frame including two spaced apart side members, each member having an inclined slot therein;

a rubber band having two ends which are of unitary construction and which are larger in dimension than the remaining portion of the band and the slots in the members, said remaining portion of the rubber band received in said slots so that the rubber band is in tension with its ends outside the frame and abutting the frame;

a shaft rotatably carried by said members;

a toy windmill connected to said shaft for rotating the shaft;

a drum carried by said frame;

one or more drumsticks carried by said rubber band in such manner that at least one first end of a drumstick is urged towards and held against the drum by the rubber band;

at least one paddle carried by said shaft and swung through a predetermined path when the shaft is rotated, wherein at least the other end of a drumstick opposite to the first end lies in the path of a paddle so as to be intermittently struck thereby during the rotation of said shaft, causing the first end to be intermittently moved away from the drum and then moved back towards the drum to intermittently strike the drum, thereby producing noise; and a handle connected to the substantially rectangular frame at or near the center of one side of said frame, so that when the device is held by the handle and when the shaft is rotated by the windmill, causing the drumsticks to strike the drum, the device is substantially balanced at least one drumstick has a neck which is of a smaller cross-section than adjacent portions of the drumstick, wherein said rubber band defines a hole therein into which the neck of the drumstick fits snugly and wherein the neck is short so that when such drumstick is held by inserting the drumstick into said hole until its neck is held by the rubber band at the hole, the rubber band abuts the adjacent portions thereby preventing the drumstick from sliding through the hole.

2. A toy windmill and noise maker device comprising:

a substantially square or rectangular frame, said frame including two spaced apart members and a bottom member, each of the two spaced apart members having an inclined slot therein, said two members and the bottom member each having a finger protruding from the inside surfaces of the frame;

a rubber band received in said slots so that the rubber band is in tension;

a shaft rotatably carried by said members;

a toy windmill connected to said shaft for rotating the shaft;

a drum comprising a drum head and a flange, said flange defining three holes therein into which the fingers protruding from the inside surface of the frame fit thereby holding the drum to the frame, wherein said bottom member of the frame defines a depression on its surface near the finger thereon, said depression shaped so that when the drum is held in place by the three fingers, the drum is spaced apart from the bottom member to avoid damping vibrations of the drum, said flange formed by an endless strip of material having a first edge integral with the drum head and a second edge;

one or more drumsticks carried by said rubber band in such manner that at least one first end of a drumstick is urged towards and held against the drum by the rubber band;

at least one paddle carried by said shaft and swung through a predetermined path when the shaft is rotated, wherein at least the other end of a drumstick opposite to the first end lies in the path of a paddle so as to be intermittently struck thereby during the rotation of said shaft, causing the first end to be intermittently moved away from the drum and then moved back towards the drum to intermittently strike the drum, thereby producing noise; and a handle connected to the substantially rectangular frame at or near the center of one side of said frame, so that when the device is held by the handle and when the shaft is rotated by the windmill, causing the drumsticks to strike the drum, the device is substantially balanced.

3. The device of claim 2, wherein the second edge of said flange of the drum is folded towards the inside of the drum to further avoid contact with the bottom member.

4. A toy windmill comprising:

a square flexible blank provided with arcuate cuts to form four windmill blades with integral extensions that extend transversely to the blades, the four extensions being arranged in two pairs with the extensions of each pair being disposed diametrically apart; and wherein the end of one extension in each pair being an arrowshaped tongue, and the end of the other extension in the pair defining a slot in the shape of numeral "7" having a longer section substantially in the same direction as the length of the extension and a shorter section in a direction transverse thereto, said tongue having a neck portion having smaller dimensions than the shorter section of the slot and a head portion of greater dimensions than the shorter section, so that when the tongues are inserted into the associated slot, the tongues are retained within the shorter sections thereby removably connecting the extension pairs and the planes of the tongues are substantially parallel to those of the ends with slots therein.

5. The windmill of claim 4, further comprising:

a support member; and a shaft for connecting the blank to the support member, wherein one end of the shaft to be connected to the blank is generally triangular in cross section with rounded corners.

* * * * *